US008770541B2

(12) United States Patent
Wood

(10) Patent No.: US 8,770,541 B2
(45) Date of Patent: Jul. 8, 2014

(54) SEALING APPARATUS AND METHOD

(75) Inventor: Carl Richard Wood, Alford (GB)

(73) Assignee: National Oilwell Varco UK, Limited, Audenshaw (GB)

( * ) Notice: Subject to any disclaimer, the term of this patent is extended or adjusted under 35 U.S.C. 154(b) by 89 days.

(21) Appl. No.: 13/391,674

(22) PCT Filed: Sep. 1, 2010

(86) PCT No.: PCT/GB2010/051438

§ 371 (c)(1),
(2), (4) Date: May 23, 2012

(87) PCT Pub. No.: WO2011/027149

PCT Pub. Date: Mar. 10, 2011

(65) Prior Publication Data

US 2012/0241663 A1 Sep. 27, 2012

(30) Foreign Application Priority Data

Sep. 1, 2009 (GB) ..... 0915085.5

(51) Int. Cl.
*E21B 33/06* (2006.01)

(52) U.S. Cl.
USPC ..... 251/1.3; 166/363; 166/85.4

(58) Field of Classification Search
USPC ..... 251/1.1, 1.3; 166/363, 364, 85.4
See application file for complete search history.

(56) References Cited

U.S. PATENT DOCUMENTS

| | | | | | |
|---|---|---|---|---|---|
| 4,227,543 | A | * | 10/1980 | Williams, Jr. | 137/246.22 |
| 4,456,215 | A | | 6/1984 | Bishop et al. | |
| 4,938,290 | A | * | 7/1990 | Leggett et al. | 166/387 |
| 5,287,879 | A | * | 2/1994 | Leggett et al. | 137/246.22 |
| 5,294,088 | A | * | 3/1994 | McWhorter et al. | 251/1.3 |
| 5,603,481 | A | * | 2/1997 | Parker et al. | 251/1.3 |
| 6,845,958 | B2 | * | 1/2005 | Wood et al. | 251/1.1 |
| 2004/0262551 | A1 | * | 12/2004 | Lam | 251/1.3 |
| 2008/0135791 | A1 | | 6/2008 | Juda et al. | |
| 2008/0296016 | A1 | | 12/2008 | Hughes et al. | |

OTHER PUBLICATIONS

Morrish, Susan, "International Search Report" for PCT/GB2010/051438, as mailed Aug. 16, 2011, 4 pages.

* cited by examiner

*Primary Examiner* — John K Fristoe, Jr.
*Assistant Examiner* — Daphne M Barry
(74) *Attorney, Agent, or Firm* — Winstead PC

(57) ABSTRACT

A sealing apparatus and method is disclosed, particularly for sealing around an elongate member which passes through a throughbore of a valve device, the apparatus having an upper sealing element and a lower sealing element, each being adapted to change configuration from an open configuration to a sealed configuration within the valve device to seal the throughbore of the valve device around the elongate member. The upper and lower sealing elements are separate and moveable independently from one another, and are configured to be actuated between open and sealed configurations by a common actuator. This actuation reduces the stack height and the weight of the valve, and reduces the number of well seals.

36 Claims, 6 Drawing Sheets

SEALING APPARATUS AND METHOD

The present invention relates to sealing apparatus and methods typically for use in wireline valves, particularly but not exclusively, used in the oil and gas industries. The invention is particularly useful in wireline valves, but can be applied to other situations where it is required to seal the annulus around an elongate member, in apparatus typically called blow out preventers, or BOPs.

Conventionally, wireline valves are used to control wellbore pressure during wireline intervention operations. Wireline valves typically press opposing pairs of ram assemblies against the wireline to provide a double safety barrier against well pressure whilst remedial work is carried out, typically on the wire.

Conventionally, the ram assemblies use resilient (e.g. rubber) seals mounted on the inner faces of two opposing ram assemblies within the wireline valve, to clamp the wireline cable between the seals, thereby containing the pressure. The inner faces of the seals typically have a recess which conforms to the outer surface of the wireline. The ram assemblies and seals move against the wireline cable, typically from opposite sides of the valve, to close off the annulus surrounding the wireline cable. Grease is then typically pumped into and around the wireline cable. The resilient seals are supported by (typically metal) plates in the ram assemblies which retain the resilient seals in place resisting movement of the seals in response to the pressure differential across them. Conventional wireline valves have two pairs of seals, e.g. a pair of upper seals and a pair of lower seals, each seal independently moved by its own actuator (e.g. a hydraulic cylinder in most cases) with a grease chamber between the upper and lower seals, allowing the injection of the grease into the chamber between them when they are clamped against the wireline cable.

In accordance with a first aspect of the present invention, there is provided sealing apparatus for sealing around an elongate member which passes through a throughbore of a valve device, the apparatus comprising an upper sealing element and a lower sealing element, each being adapted to change configuration from an open configuration to a sealed configuration within the valve device to seal the throughbore of the valve device around the elongate member, the upper and lower sealing elements being separate and moveable independently from one another, and being configured to be actuated between open and sealed configurations by a common actuator.

Typically the upper and lower sealing elements are spaced apart on the valve device, typically by a very small clearance, e.g. less than 5 mm.

The change in configuration can be a change in position, e.g. movement, or can be a change in shape. In typical embodiments of the invention, the sealing elements move from one configuration to the other. In some embodiments, the upper and lower sealing elements can be in contact with one another in their open configuration, and can optionally move apart from one another along the axis of the throughbore when changing between the open configuration and the closed configuration. Typically the sealing elements are axially separated from one another by a small distance when grease is injected between them.

Typically the upper and lower sealing elements each comprise a first and second seal, e.g. a left and right seal, which optionally move in the same plane against the elongate member, typically from opposite directions.

The seals are typically housed in ram assemblies, which approach the elongate member from opposite directions, optionally in the same plane, and seal against one another. Therefore, a typical embodiment of the invention could comprise two ram assemblies each ram assembly having two separately movable upper and lower sealing elements.

The invention also provides a ram assembly for a wireline valve, the ram assembly comprising at least two sealing elements, wherein each of the sealing elements are separate and are movable independently from one another, and are configured to be actuated by a common actuator.

Typically the actuator comprises a hydraulic cylinder. Typically the sealing elements engage a stem connected to the piston on the cylinder.

In accordance with a further aspect of the present invention, there is provided a method of sealing around an elongate member which passes through a throughbore of a valve device, the method comprising providing an upper sealing element and a lower sealing element spaced apart on the valve device, and each being adapted to change configuration from an open configuration to a sealed configuration within the valve device to seal the throughbore of the valve device around the elongate member, the upper and lower sealing elements being separate and being movable independently from one another, and actuating the sealing elements between open and sealed configurations using a common actuator.

The upper and lower sealing elements are typically mounted on a common ram assembly on each side of the elongate member.

In a typical embodiment, the first upper and lower sealing elements (e.g. those on the left side) are actuated by one actuator (e.g. one hydraulic cylinder located on the left of the wireline, and the left hand seals are typically engaged by the same stem of the left hand hydraulic cylinder) and the second upper and lower mechanisms (e.g. those on the right side) are typically actuated by a second actuator (e.g. a second, separate stem of a second separate hydraulic cylinder to the first hydraulic cylinder, located on the right side of the wireline).

In some embodiments, a single actuator can be used to activate the two seals, rather than two actuators acting on respective pairs of seals. Where two actuators are used on the same plane, they can be diametrically opposed to one another, or can be arranged at some other angle that is more or less than 180°. In some embodiments, a single seal (with two seal assemblies) can be movable from one side, typically under the force applied by one actuator from that side.

The elongate member is typically a wireline, logging line, cable or the like. In a typical embodiment, the upper and lower sealing elements on each side are arranged on a single common ram assembly, which is actuated by a single respective actuator on each side.

Typically, the ram assembly on each side of the valve can have guide arms to guide and centralise the wireline or other elongate member, and the guide arms can optionally interlock and cooperate with one another to guide the wireline etc into a suitable position relative to the sealing elements for actuation of the actuators to seal with throughbore. Thus each ram assembly (left and right) can have a pair of guide arms, and optionally two pairs of guide arms. Typically, the left and right ram assemblies are arranged substantially diametrically opposite one another about the longitudinal axis of the throughbore. Optionally, the guide arms are arranged about the recess adapted to accept the elongate member therein.

In one embodiment of the invention, each valve has a longitudinal throughbore for receiving the elongate member (e.g. the wireline) and the throughbore has left and right ram housings in the form of lateral ram bores, which intersect with the throughbore and which house left and right ram assemblies that move within the ram bores in a common plane that is perpendicular to the throughbore. Each ram assembly (e.g. left and right) has a pair of sealing elements, upper and lower. Each of the sealing elements typically have a pair of seals, optionally in the form of inner seals at their radially inner faces, to bear against the elongate member to seal off the throughbore, and an outer seal typically housed in a groove, which can be annular or partially annular, and which typically seals the annulus between the ram bores and the ram assemblies. Typically the inner and outer seals on each sealing element connect to complete the seal. However it is not necessary for the seal on each side to move, and in some embodiments only a single seal on one side is movable.

Typically the ram assemblies and optionally the sealing assemblies are resistant to rotation within the ram bores. Typically the ram assemblies and optionally the sealing assemblies are non-circular, and thereby resist rotation.

In one embodiment, at least one of the sealing elements (and typically both of them) is movable relative to the common actuator, and this is typically achieved by a constraining connection between the actuator and the sealing elements.

As one example of a constraining connection between the sealing elements and the actuator, the radially outermost end of each of the ram assemblies in one embodiment typically each have an axial channel, groove or slot in which a portion of the driver (e.g. a head or pin) is captive, but is constrained to move axially along the length of the channel, groove or slot, which can typically be co-axial with the axis of movement of the sealing element. The driver portion can only move within the confines of the slot, and is typically axially shallower than the slot, so as to allow relative axial movement between the two, but to restrict or deny relative lateral and optionally rotational movement. In one embodiment, the portion of the driver can comprise a T-shaped head of part of the actuator, and the head can be located in the channel, groove or slot. A typical actuator comprises a hydraulic cylinder, usually located within the ram bore, but the particular design of actuator is not important, and a mechanical screw actuator can be used instead of a hydraulic cylinder if desired.

The channel on the radially outermost end of the ram assembly typically accepts captive portion that is optionally in the form of a T-shaped head on the stem of the hydraulic cylinder, and retains the T-shaped head within the channel by means of a lip on the inner surface of the channel, which prevents the T-shaped head from pulling out of the channel. The channel can be a simple recess formed in opposing faces of the upper and lower sealing elements of the ram assemblies, and the recesses on each of the upper and lower sealing elements can typically align to form the channel between them, thereby allowing them to be assembled around the head of the stem and retain the head in the channel.

The channel typically can have a neck to receive the stem, and the neck can have a narrower diameter than the head, thereby allowing passage of the stem through the neck but retaining the head within the confines of the channel. The depth of the channel in the axial direction of movement of the head typically has a greater dimension than the depth of the head, so the head can travel within the channel for a small distance before abutting the neck at the outboard end of the channel or the wall of the sealing element at the inboard end of the channel. The desired limitations to movement in each case are typically related to the resilience and size of the inner seal, and the axial distance that the head can move within the channel is different depending on the different characteristics of the inner seal, which can vary in different cases and is not intended to be a limiting feature of the invention. For example, in some cases, for example with small seals adapted to hold a slim wireline with a very narrow bore, the axial distance of travel of the head of the stem can be e.g. 2-3 millimeters, but in larger valves with larger and/or more resilient seals, the axial distance of travel can be e.g. 10-15 mm.

The channel is typically formed from two machined semi-circular recesses in the outer ends of the bodies of the sealing elements, which cooperate to form the channel, and retain the head of the stem. The body of either one of the two sealing elements can therefore move independently of the other on the ram assembly, relative to the actuator, while the other remains stationary and engaged with the T-shaped head of the stem. Accordingly the sealing elements can react independently of one another to pressure differentials across the seals, by means of the loose fit of the actuator and the ram assembly. The loose fit of the stem in the channel is typically restrained so that the sealing elements are not entirely free to move in every plane, and the range of movement is typically restricted, e.g. to axial movement of the sealing elements relative to the stem, in the direction of movement of the stem during actuation. Typically the sealing elements are captive in ram bores and are restrained to move only along the axis of the bores, which is typically parallel with the axis of the actuator movement during actuation.

Typically the sealing elements comprise seals mounted on seal bodies to support and orientate the seals. The seal bodies typically have outer faces to engage the inner surfaces of the ram bores, and typically have mating faces, which can be flat, and which can optionally be keyed together e.g. splined in some embodiments, to guide sliding movement of the sealing elements with respect to one another. The seal bodies typically have grooves formed in the mating faces to form the channel to receive the head of the stem. In certain embodiments of the invention the seal bodies can have grease channels extending axially (e.g. parallel to the ram bore) from the inner end of the seal bodies to the outer end of the seal bodies to provide an axial channel for the injected grease to pass from the outboard face of the sealing elements typically between the seal body mating faces in order to reach the wireline clamped between the inner seals. The axial grease channel can optionally comprise an axial groove formed in one of the mating faces of the seal bodies, or can optionally be provided in both faces, and in that case, optionally the two grooves can then be superimposed on one another to form a larger conduit for the grease. The grease channel can optionally terminate in the groove that receives the stem. A grease channel can optionally be provided in one or in each of the seal bodies. The grease channel typically provides a path of little resistance to the grease injected behind the sealing elements, to allow effective penetration of the wireline cable trapped between the inner seals. Of course, grease can optionally be injected freely between the sealing bodies without any particular grease channel being provided.

The apparatus typically has a grease injection device to inject grease between the upper and lower sealing assemblies. The injection pressure of the grease typically applies additional pressure on the sealing elements to energise the seals, and can typically move one or both of the sealing elements relative to the stem and/or relative to the other sealing element.

The upper and lower sealing elements are typically oriented in different directions, to withstand pressure differentials in different e.g. opposite directions.

Actuating the upper and lower sealing elements from a common actuator reduces the stack height and the weight of the valve, and reduces the number of well seals.

Embodiments of the present invention will now be described, by way of example only, with reference to the accompanying drawings, in which:—

FIGS. 1, 10 and 12 show a wireline valve V for use with wireline cable (not shown) in an oil or gas well. The wireline valve V is typically used to close off the throughbore 2 of the valve to contain the pressure beneath it in the well.

Figure 1:
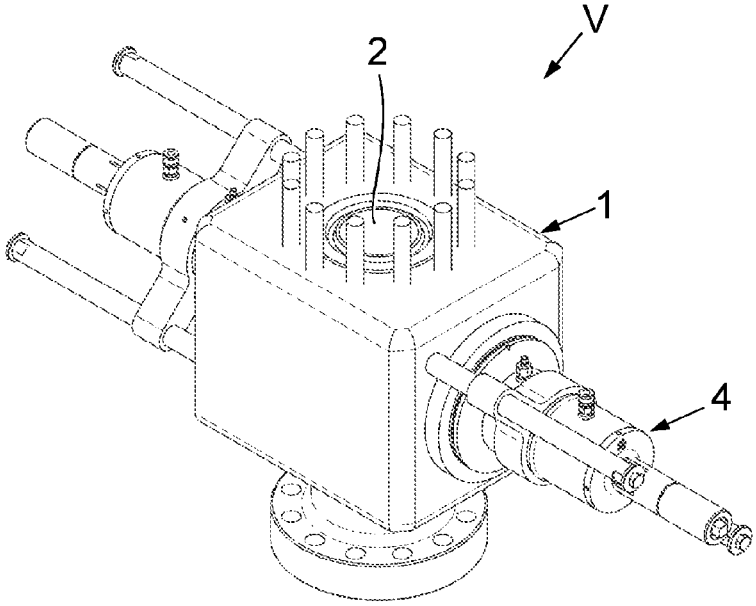
FIG. 1 is a perspective view of a wireline valve embodying sealing apparatus of the invention.
Figure 2:
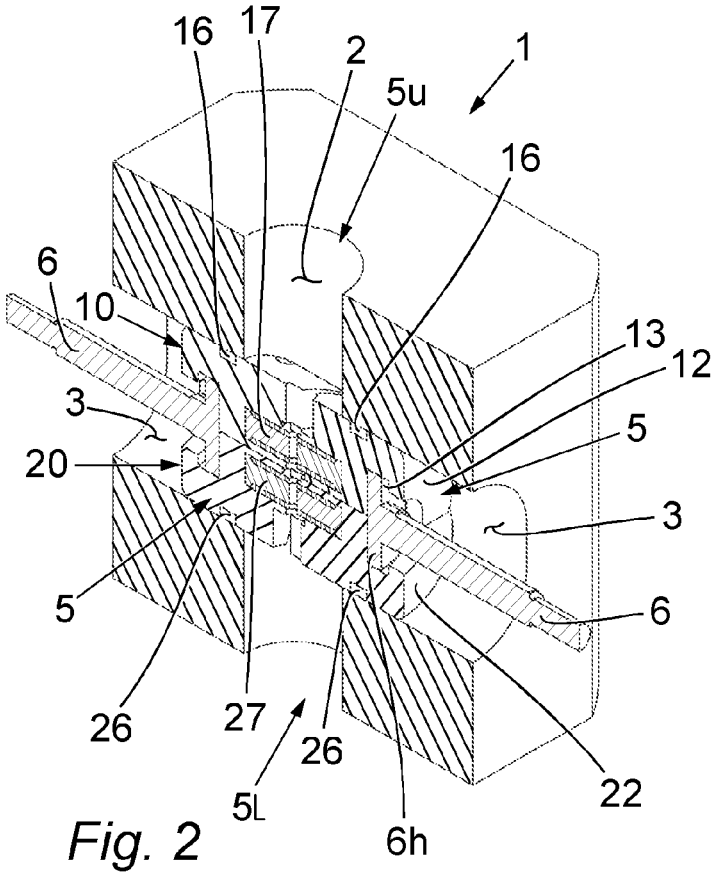
FIG. 2 is a perspective cutaway view of a simplified view of sealing apparatus from the valve in FIG. 1.

The valve V has a body 1 shown in sectional view in FIG. 2, having a vertical throughbore 2 through the body 1 for communication with a well bore of an oil or gas well. The throughbore 2 has an upper port 5*u* and a lower port 5*l*, and typically accommodates a wireline (not shown) passing between the ports 5*u*, 5*l*, and generally extending along the central axis 2*x* of the throughbore 2. The body 1 has a pair of lateral ram bores 3 connecting the vertical throughbore 2 with the left and right faces of the body 1. The ram bores 3 each house a ram assembly 5 in right and left side bores 3 respectively.

The ram assemblies 5 in the left and right bores are substantially similar to one another, and are pushed axially through the ram bores 3 by actuators. In this embodiment, the actuator is in the form of a stem 6 that is moved axially through the ram bore 3 by a suitable driver, such as a hydraulic cylinder 4. The particular type of driver is not important, and embodiments of the invention can function satisfactorily with mechanical or other drivers, e.g. those relying on screw threads. The stem 6 has a head 6*h*.

Figure 4:
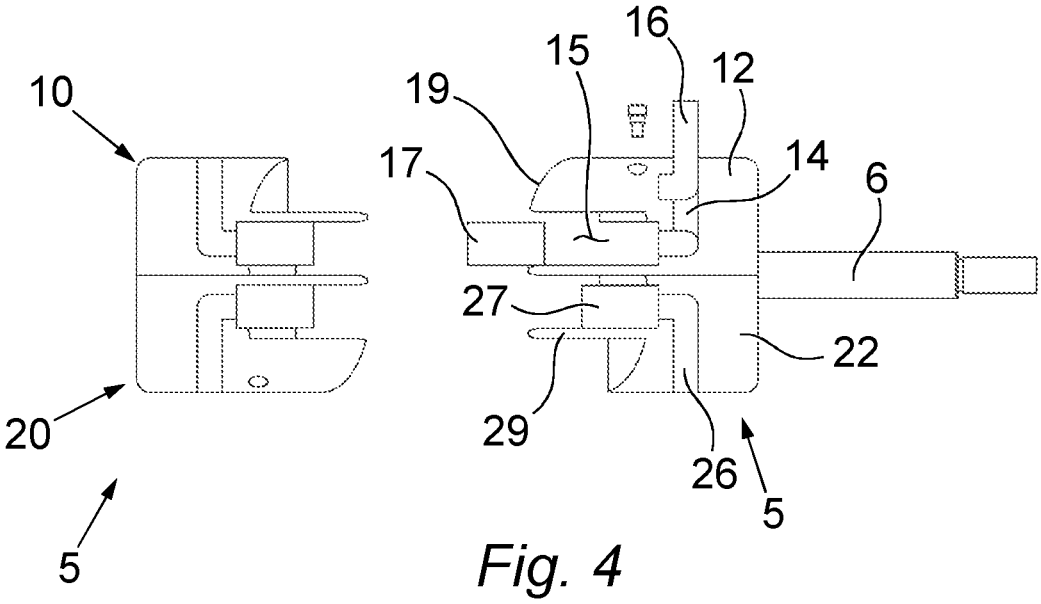
FIG. 4 is a side view of a pair of left and right ram assemblies of the sealing apparatus.
Figure 5:
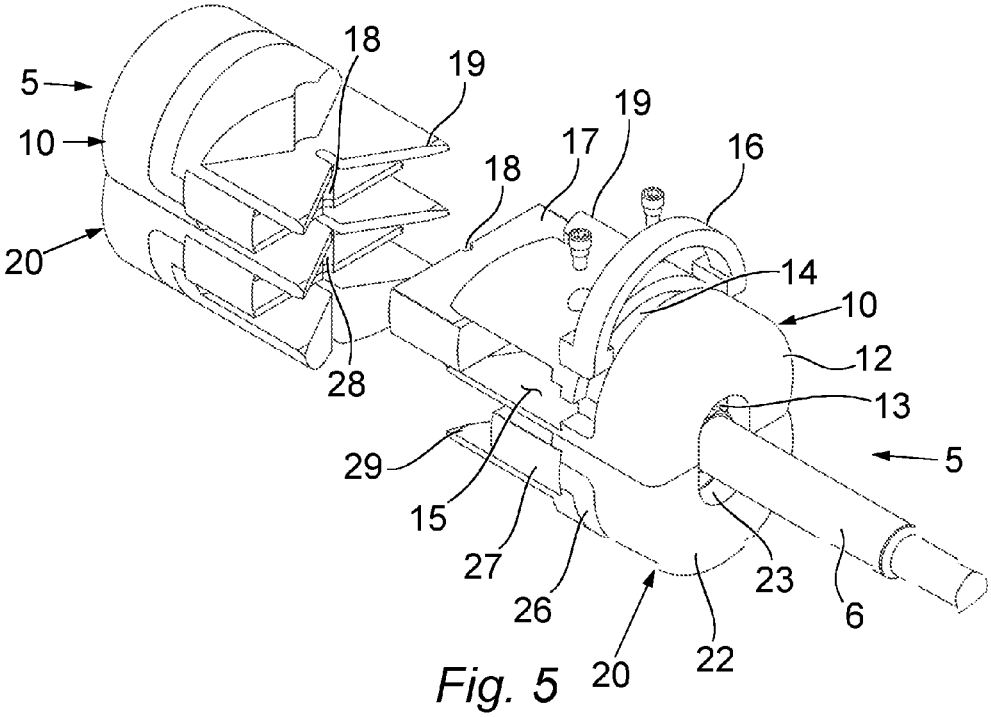
FIG. 5 is a perspective view of the ram assemblies of FIG. 4.

Each ram assembly 5 has an upper sealing element 10 and a lower sealing element 20, as shown in FIGS. 4 and 5, for example. The cross sections of the upper and lower sealing elements 10, 20 are substantially symmetrical around the plane through which the axis of the ram bore passes.

Figure 3:
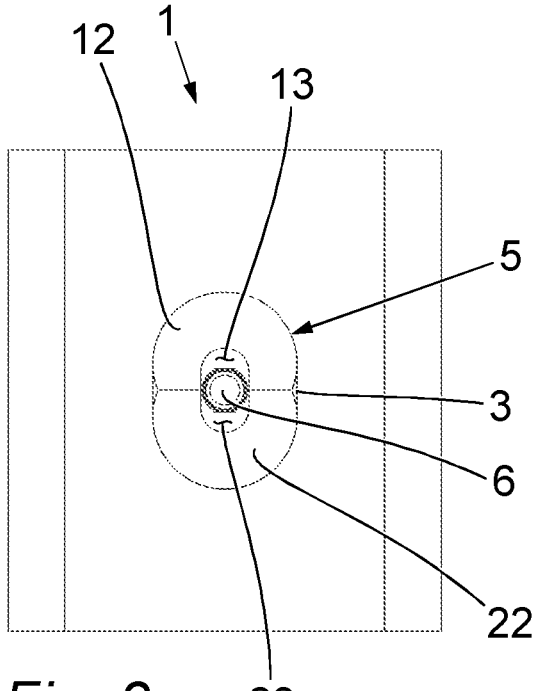
FIG. 3 is a side view of the FIG. 2 sealing apparatus.

The upper sealing element 10 has a body 12 of generally semi-cylindrical shape, with an axis that is generally parallel with an axis of the ram bore 3 in which it is housed. In this particular embodiment, the bodies 12 and 22 have generally semi-oval shapes, as is best shown in FIG. 3, although other shapes can also be used. The body 12 is typically made of steel or another metal and supports the seals as will be described below. The body 12 has an inner end, an outer end, and extending between them an arcuate upper face having a partially circumferential seal slot 14 into which an outer seal 16 is located, and a flat lower face. As shown in FIG. 4, the outer seal 16 extends around the arcuate upper surface of the body between the inner and the outer ends, and as shown in FIG. 2, seals it against the inner surface of the lateral ram bore 3. The recessed seal slot 14 supports the seal 16 against axial movement in the ram bore 3 or other collapse under high pressure differentials.

The body 12 also has an inner seal slot 15, which houses an inner seal 17 at its axially inner end, so that the inner seal 17 is located closest to the throughbore 2 of the valve 1. The inner seal 17 is optionally bounded by two metal plates which are bonded to the rubber portion during the manufacturing process, although a simple rubber block can suffice. The inner seal 17 in this embodiment is supported above and below by metal plates which place limits on the extent to which the seal 17 can deform during exposure to pressure differentials, and in this embodiment is fixed to the plates via bolts or other fixings. The innermost face of the inner seal 17 has a recess 18 which is arranged to be perpendicular to the longitudinal axis of the cylindrical ram body 12, and which is arranged to be aligned with the axis of the throughbore 2 in use.

Optionally, the body 12 has wireline guides 19 at its inner end providing inter-engaging "V" shaped guiding formations which guide a wireline into the recess 18.

At its outer end, opposite the inner seal, the body 12 has a recess, which is typically in the form of a slot or groove or channel. In this case, the recess 13 extends axially in alignment with the axis of the stem 6. The recess 13 is machined in the flat lower face, and typically has two portions, a deep groove with a wide diameter, and a lip with a restricted diameter (typically less than the diameter of the head 6*h* of the stem 6).

Figure 8:
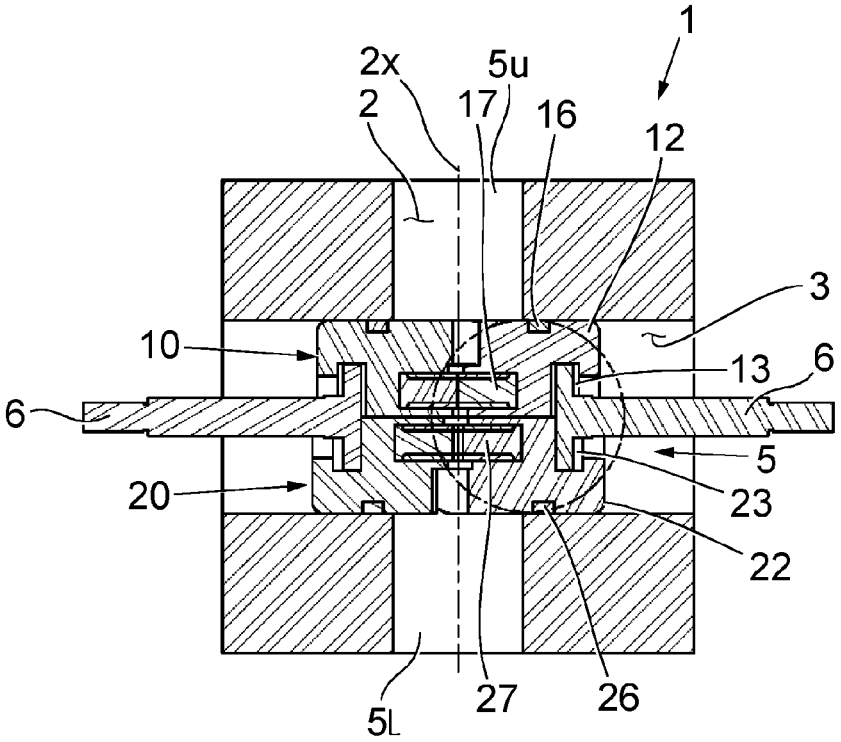
FIG. 8 is a front view of the FIG. 2 apparatus in a closed and pressurised configuration.

The lower sealing element 20 has a similar cross section to the upper sealing element, and has a body 22 of generally semi-cylindrical or semi-oval shape of steel or another metal which supports the seals. The body 22 has an arcuate lower face having a partially circumferential seal slot 24 into which an outer seal 26 is located. Like the seals on the upper sealing element 10, the outer seal 26 on the lower sealing element 20 extends around the arcuate lower surface of the body as shown in FIG. 4, and as shown in FIG. 8, seals it against the inner surface of the ram bore 3. A recessed seal slot (similar to slot 14) supports the seal 26 against collapse under high pressure differentials. The left and right lower seals 20 are not identical to one another, and are arranged to fit together to enclose and support the inner seals 27, to press them against one another. In fact, the lower sealing element 20 on the right is optionally substantially the same shape as the upper sealing element 10 on the left.

The body 22 also has an inner seal slot (similar to seal slot 15) which houses an inner seal 27 at its inner end, relative to the ram bore 3, located closest to the throughbore 2 of the valve 1. The inner seal 27 typically has the same construction as the inner seal 17.

Optionally, the body 22 has wireline guides 29 providing "V" shaped guiding formations which guide a wireline into the recess 28. The guides 29 typically cooperate with the guides 19 in the upper sealing element 10 to guide the wireline into the recesses 18 and 28, which align with one another to seal around the wireline or other elongate member.

Figure 9:
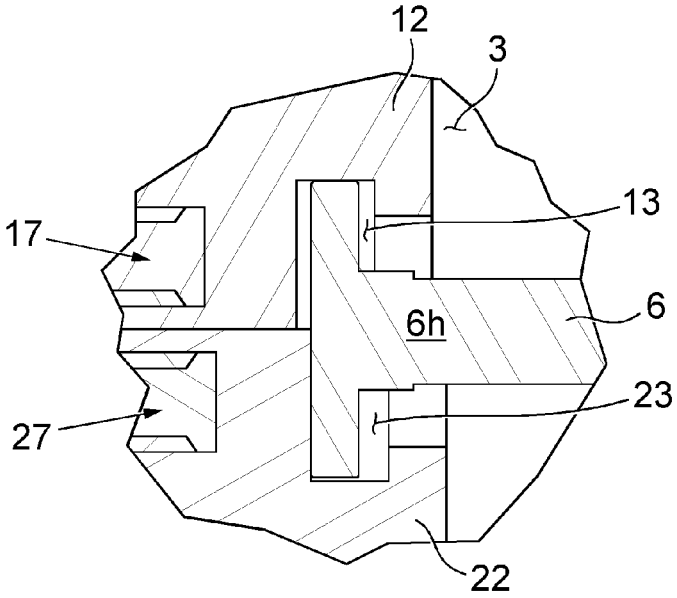
FIG. 9 is a close up view of FIG. 8.
Figure 10:
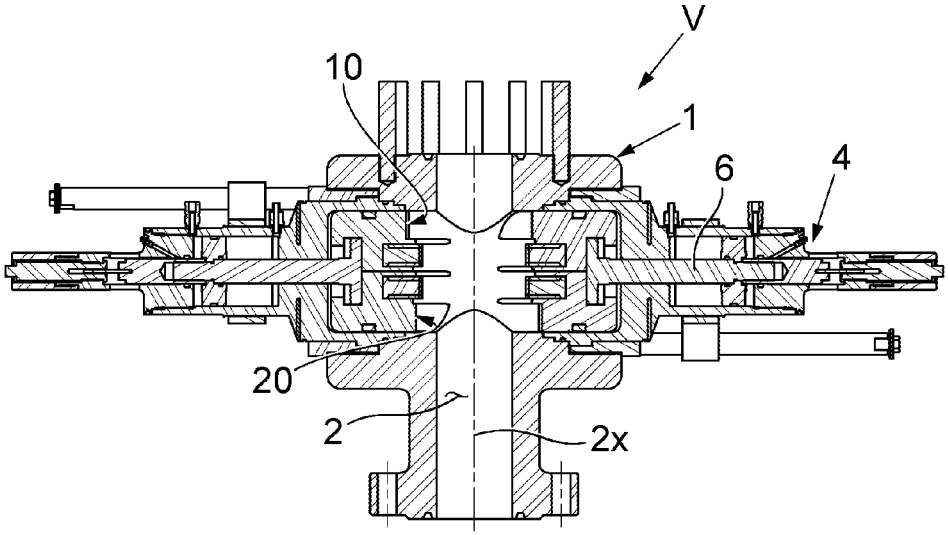
FIGS. 10, 11 and 12 are side sectional views of the valve of FIG. 1 in open, closed and pressurised positions respectively.
Figure 11:
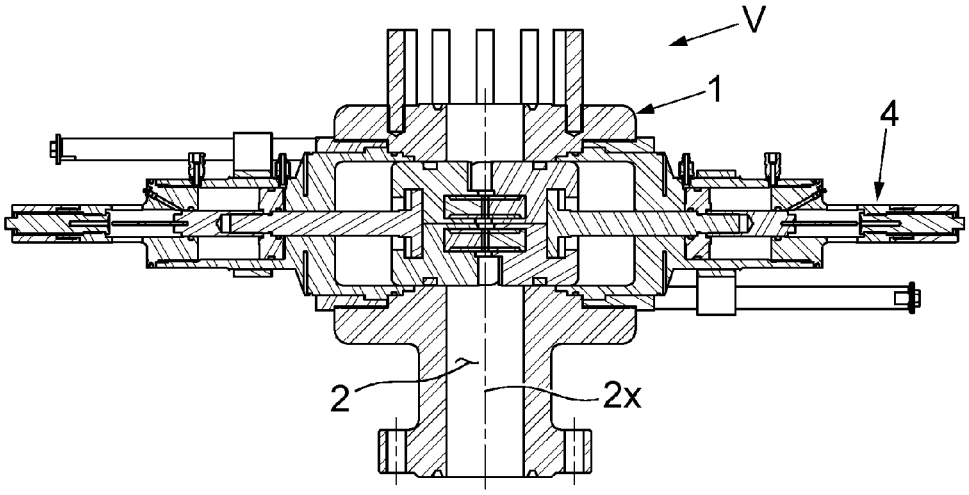
Figure 12:
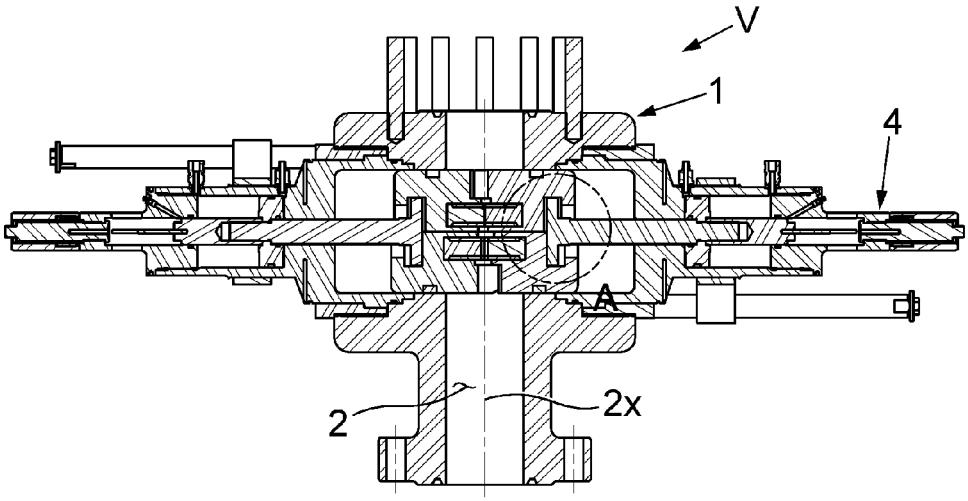

As can be seen from FIG. 9, the arrangement of the seal slots in the bodies 12 and 22 ensure that upon actuation to the sealed configuration, the seals 16 are pressed against the seals 17 and the seals 26 against the seals 27, thereby connecting the inner and outer seals in each sealing element 10, 20 and creating a pair of sealed envelopes around the wireline surrounded by the seals in use.

The lower body 22 also typically has a recess 23 in alignment with the axis of the stem 6 at its radially outer end, and in alignment with the recess 13 in the upper sealing element body. The recesses 13 and 23 combine to form a bore to receive and retain the head 6*h* of the stem 6 at the outer end of the sealing elements 10, 20. The bore is formed by the juxtaposition of the semi-annular recesses 13, 23 in the symmetrical upper and lower sealing bodies 12, 22.

Figure 6:
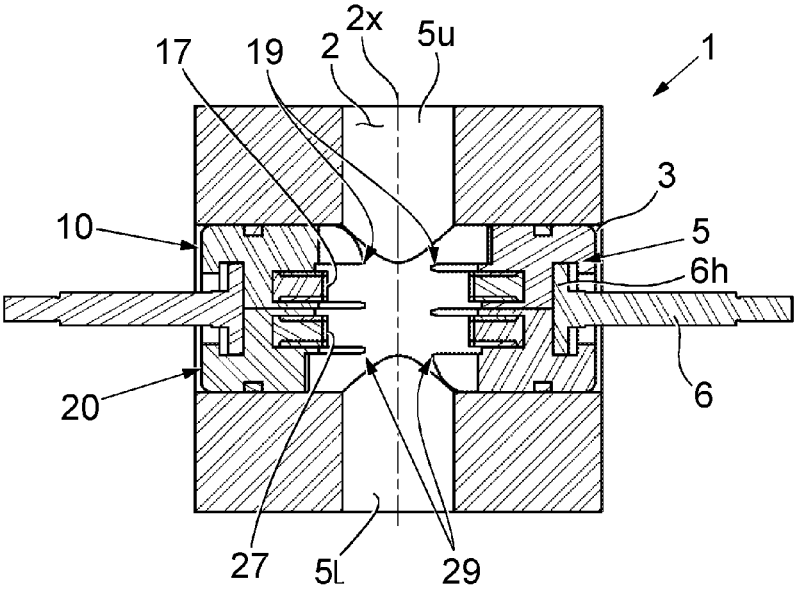
FIG. 6 is a front view of the FIG. 2 apparatus in an open configuration.

The left and right ram assemblies 5 each comprising the upper and lower sealing elements 10, 20 are placed within the respective ram bores 3 on the left and right of the wireline valve 1, and in normal operation of the wireline valve, the pair of ram assemblies 5 will be located in the position shown in FIG. 6 such that they are not interfering with the throughbore 2 of the wireline valve 1. However, when intervention is required, such that sealing around the wireline at the point at which it passes through the wireline valve throughbore 2 is required, then the ram assemblies 5 are pushed toward one another by the hydraulic cylinders 4 acting on the stems 6 on the left and right which are coupled to the respective left and right ram assemblies 5 by means of the channels 13 which retain the heads **6*h* of the stems 6**.

Figure 7:
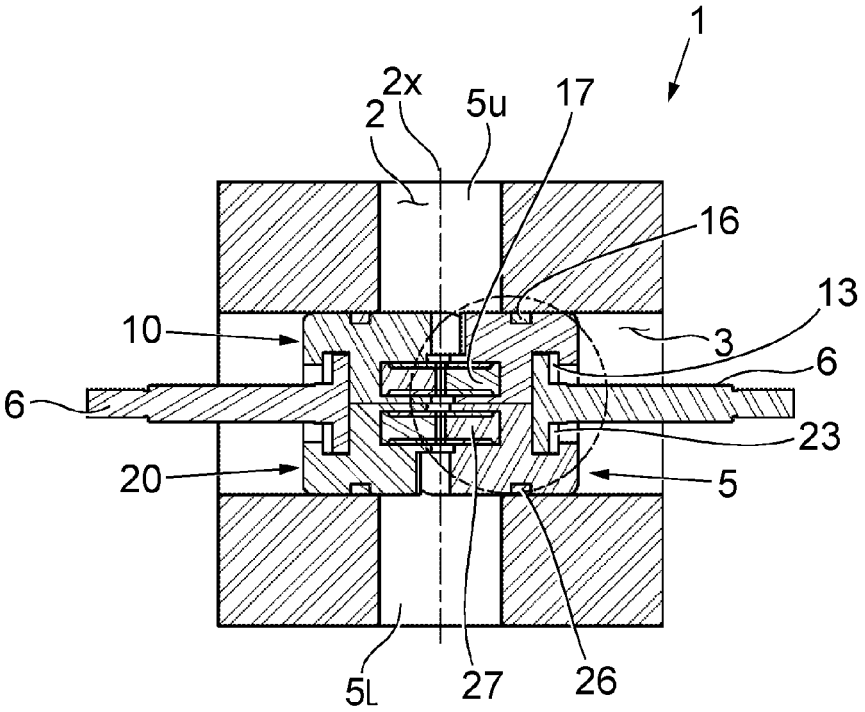
FIG. 7 is a front view of the FIG. 2 apparatus in a closed configuration.

The left and right rams 5 approach one another under the force applied via the stems 6, as shown in FIG. 7 and are arranged such that the wireline guides 19 and 29 are in a sliding fit with one another, and inter-engage, thereby ensuring that the wireline will be picked up by the arrangement of wireline guides 19, 29 and as the left and right ram assemblies 5 are moved toward one another, the wireline will be guided until it is located in the aligned recesses 18, 28 formed between the inner seals 17, 27.

The ram assemblies 5 continue to move toward one another until the inner seals 17, 27 are pressed together, which also presses the outboard ends of the inner seals 17, 27 against the adjacent ends of the outer seals 16, 26. Thus, the leak paths surrounding the upper port **5*u* are sealed by the seals 16, 17 on the upper sealing element 10 and the lower port 5*l* is sealed by the seals 26, 27 on the lower sealing element 20**, and in each case the inner and outer seals connect to completely seal around the port, thus ensuring that the pressure in the wellbore below the wireline valve is retained by two complete (upper and lower) barriers.

The grease is typically injected between the upper and lower sealing elements 10, 20 under high pressure, typically at a higher pressure than the wellbore pressure than the valve is rated to contain. For example, where the wireline valve is rated at 10 kpsi, it is used where the wellbore pressure is typically less than this, and a typical wellbore pressure for such a valve might be around 8 kpsi. The grease is typically injected into the ram bore 3, behind the outer seals 16, 26 at a pressure that is around 10-20% higher, e.g. 10 kpsi. The stem 6 is not sealed to the ram assemblies 5, so grease is squeezed into the space between the inner seals 17, 27 and into the leak paths within the many strands of wire in the wireline cable. Typically the sealing elements 10, 20 are initially touching or are closely adjacent to one another in the open configuration, but as the grease is injected in the closed configuration the sealing elements 10, 20 are typically pushed axially apart from one another by the injection of the grease, by a small distance related to the tolerance of the ram assemblies 5 within the ram bores 3. This is advantageous, as it allows the creation of a small grease chamber between the seals.

Therefore, the pressure differential across the two sealing elements 10, 20 is not equal, because the conduit immediately below the valve 1 is at 10,000 psi, and the conduit immediately above the valve 1 is at atmospheric pressure, so the upper sealing element 10 is exposed to a far greater pressure differential than the lower sealing element 20.

Therefore, when the sealing elements 10, 20 are sealed against the wireline and the grease pressure is applied to pump the grease into the wireline and close the leak paths between the upper and lower ports **5*u*, 5*l*, the inner seals 17, 27 are able to move axially within the ram bores 3 in accordance with the pressure differential to which they are exposed. The force applied to the lower sealing element 20 by the moderate pressure differential across the lower sealing element 20 is not usually sufficient in normal wellbore conditions to overcome the reaction force of the resilient inner seal 17 reacting to the pressure of the head 6*h* of the stem 6 against the lower body 22. Therefore, under normal conditions, the head 6*h* remains pressed hard against the radially outer end of the channel 13 while the inner seal 27 on the lower sealing assembly is kept pressed against the wireline cable and against the opposing inner seal 27. However, since the throughbore pressure immediately above the wireline valve V is much lower than the pressure below it, and since the same grease pressure is applied to bore the upper and the lower sealing elements 10, 20, the upper sealing element 10 is exposed to a much higher pressure differential than the lower sealing element 20. Therefore, the same grease pressure behind the outer seals 16, 26 applies more force to the upper sealing element 10 than to the lower sealing element 20. The force applied to the upper sealing element 10 by the pressure differential is higher than the force applied by the hydraulic cylinder 4 and stem 6, and so the upper sealing element 10** is pressed axially against the wireline cable not by the hydraulic pressure but by the pressure differential between the injected grease and the bore immediately above the wireline valve V.

One benefit of the present arrangement is that in the event of transient wellbore pressure spikes below the valve, the high pressure kick below the valve increases the pressure differential applied to the upper sealing elements 10, and this causes the upper seals to move closer together as shown in FIG. 9 within the constraints of the head **6*h* moving axially within the channel 13, so that the inner seals 17** are pressed harder together, thereby self energising the valve seals without external control or power, as an automatic reaction to the wellbore pressure spike.

Modifications and improvements may be made to the foregoing embodiments with departing from the scope of the invention.

The invention claimed is:

1. A sealing apparatus for sealing around an elongate member which passes through a throughbore of a valve device, the apparatus comprising:

a first ram assembly housed in a first ram bore and a second ram assembly housed in a second ram bore, each ram assembly having an upper sealing element comprising an upper seal mounted on an upper seal body arranged to support and orientate the upper seal and the lower sealing element comprising a lower seal mounted on a lower seal body arranged to support and orientate the lower seal, each of the upper and lower sealing elements being adapted to change configuration from an open configuration to a sealed configuration within the valve device to seal the throughbore of the valve device around the elongate member, wherein the upper and lower seal bodies in each ram bore are separate and axially moveable within the ram bore independently from one another, and are configured to be actuated between open and sealed configurations by a common actuator.

2. A sealing apparatus as claimed in claim 1, wherein the throughbore of the valve device has an axis (2×), and wherein the upper and lower seal bodies are spaced apart along the axis (2×) of the throughbore, and are separated along the axis (2×) of the throughbore by a distance of less than 5 mm.

3. A sealing apparatus as claimed in claim 1, wherein the upper and lower seal bodies are housed in the same bore.

4. A sealing apparatus as claimed in claim 1, wherein the upper and lower seal bodies change configuration by moving from one configuration to the other.

5. A sealing apparatus as claimed in claim 1, wherein one ram assembly is arranged on a left side of the valve device and the other ram assembly is arranged on a right side of the valve device.

6. A sealing apparatus as claimed in claim 1, wherein the valve device has a longitudinal throughbore for receiving the elongate member and the throughbore has left and right ram housings in the form of lateral ram bores, which intersect with the throughbore and which house left and right ram assemblies that move axially within the ram bores in a common plane that is perpendicular to the throughbore.

7. A sealing apparatus as claimed in claim 6, wherein the ram assemblies on the left and right side of the valve device are arranged diametrically opposite one another about the longitudinal axis of the throughbore.

8. A sealing apparatus as claimed in claim 1, wherein the upper and lower seal bodies each have an inner seal disposed in a slot at the radially inner face of the upper and lower seal bodies, to bear against the elongate member to seal off the throughbore, and an outer seal housed in a groove in the seal bodies, to seal the annulus between the ram bores and the ram assemblies.

9. A sealing apparatus as claimed in claim 8, wherein the inner seals have a recess which is arranged to be perpendicular to the longitudinal axis of the ram assembly and which is arranged to be aligned with the axis (2×) of the throughbore in use.

10. A sealing apparatus as claimed in claim 1, wherein the seal bodies are arranged to be resistant to axial rotation.

11. A sealing apparatus as claimed in claim 1, wherein at least one of the seal bodies is moveable relative to the common actuator.

12. A sealing apparatus as claimed in claim 11, wherein a radially outermost end of at least one of the sealing elements has an axial channel in which a portion of the actuator is captive, and wherein the portion of the actuator that is captive within the channel is adapted to move along the length of the channel.

13. A sealing apparatus as claimed in claim 12, wherein the captive portion of the actuator is axially shorter than the channel to allow relative axial movement of the captive portion along the channel when the captive portion is captive within the channel.

14. A sealing apparatus as claimed in claim 12, wherein the channel comprises a pair of recesses formed in opposing faces of the upper and lower seal bodies of the ram assemblies, and wherein the recesses on each of the upper and lower seal bodies are adapted to align to form the channel between them.

15. A sealing apparatus as claimed in claim 12, wherein the channel has a neck to receive part of the actuator forming a stem, and wherein the captive portion of the actuator comprises a head, and wherein the neck has a narrower diameter than the head.

16. A sealing apparatus as claimed in claim 1, wherein each one of the two seal bodies is moveable independently of the other relative to the actuator while the other seal body remains stationary and engaged with the captive portion of the actuator.

17. A sealing apparatus as claimed in claim 1, wherein at least one of the seal bodies has at least one grease channel extending axially from an inner end of the seal bodies to an outer end of the respective seal body to provide an axial grease channel.

18. A sealing apparatus as claimed in claim 17, the apparatus having a grease injection device to inject grease between the upper and lower sealing elements.

19. A sealing apparatus as claimed in claim 1, wherein the upper and lower sealing elements are oriented in different directions.

20. A sealing apparatus as claimed in claim 1, wherein the elongate member is a wireline, a logging line or a cable.

21. A sealing apparatus as claimed in claim 1, wherein the upper and lower seal bodies are in contact with one another in the open configuration.

22. A sealing apparatus as claimed in claim 1, wherein the upper and lower sealing elements can move apart from one another along the axis of the throughbore when changing between the open configuration and the closed configuration.

23. A ram assembly for a valve device having at least one ram bore, the ram assembly having at least two sealing elements housed in the at least one ram bore, wherein each of the at least two sealing elements are separate and are movable independently from one another, and are configured to be actuated by a common actuator.

24. A ram assembly as claimed in claim 23, wherein the sealing elements engage a stem connected to the actuator.

25. A ram assembly as claimed in claim 23, wherein the ram bore is non-circular.

26. A method of sealing around an elongate member which passes through a throughbore of a valve device, the method comprising:

housing a first ram assembly in a first bore on a first side of an elongate member, and a second ram assembly on a second ram bore on a second side of the elongate member, each ram assembly having an upper sealing element comprising an upper seal mounted on an upper seal body arranged to support and orientate the upper seal and a lower sealing element comprising a lower seal mounted on a lower seal body arranged to support and orientate the lower seal, the upper and lower sealing elements being spaced apart on the valve device, and each sealing element being adapted to change configuration from an open configuration to a sealed configuration within the valve device to seal the throughbore of the valve device around the elongate member; wherein the upper and lower seal bodies in each ram bore are separate and axially movable independently from one another within the ram bore; and wherein the method includes: actuating the seal bodies in the first ram assembly between open and sealed configurations using a first common actuator, and actuating the seal bodies in the second ram assembly between open and sealed configurations using a second common actuator.

27. A method as claimed in claim 26, wherein the elongate member is guided and centralised by wireline guides which are provided on the respective ram assembly on each side of the valve.

28. A method as claimed in claim 26, wherein the elongate member is received in a longitudinal throughbore, and wherein left and right ram housings of the longitudinal throughbore in the form of lateral ram bores intersect with the throughbore, and wherein the left and right ram housings house respective left and right ram assemblies that move within the ram bores in a common plane perpendicular to the throughbore to open or seal the valve device.

29. A method as claimed in claim 26, wherein each pair of upper and lower seal bodies is housed in a respective ram bore in the body of the valve.

30. A method as claimed in 29, wherein each ram assembly has a pair of sealing elements, and wherein each of the sealing elements have a pair of seals in the form of inner seals at their radially inner faces, wherein the inner seals bear against the elongate member to seal off the throughbore, and in the form of outer seals housed in a groove, and wherein the outer seals seal the annulus between the ram bores and the ram assemblies.

31. A method as claimed in claim 30, wherein the inner and outer seals on each sealing element connect to complete the seal when the sealing elements are actuated.

32. A method as claimed in claim 26, wherein a portion of the actuator accepted by a channel between the upper and lower seal bodies on a radially outermost end of the ram assembly is retained within the channel, and wherein each of the two seal bodies can move independently of the other, relative to the actuator, while the other seal body remains stationary and engaged with the captive portion of the actuator.

33. A method as claimed in claim 26, wherein the seal bodies are captive in the ram bores and are restrained to move only parallel to an axis of the ram bores, which is coincident with a longitudinal axis of the actuator movement during actuation.

34. A method as claimed in claim 26, wherein grease is injected into the axial space between the seal bodies to close leak paths.

35. A method as claimed in claim 26, wherein the upper and lower seal bodies are configured to move relative to each other in response to a pressure differential applied to the upper and lower seal bodies respectively.

36. A sealing apparatus for sealing around an elongate member which passes through a throughbore of a valve device, the apparatus comprising:

a first ram assembly housed in a first ram bore and a second ram assembly housed in a second ram bore, each ram assembly having an upper sealing element comprising an upper seal mounted on an upper seal body arranged to support and orientate the upper seal and a lower sealing element comprising a lower seal mounted on a lower seal body arranged to support and orientate the lower seal, each of the upper and lower sealing elements being adapted to change configuration from an open configuration to a sealed configuration within the valve device to seal the throughbore of the valve device around the elongate member; wherein the upper and lower seal bodies in each ram bore are separate and axially moveable within the ram bore independently from one another, and are configured to be actuated between open and sealed configurations by a common actuator; wherein at least one of the sealed bodies in each ram bore is moveable relative to the common actuator; wherein a radially outermost end of at least one of the sealing elements in each ram bore has an axial channel.

* * * * *

UNITED STATES PATENT AND TRADEMARK OFFICE

CERTIFICATE OF CORRECTION

PATENT NO. : 8,770,541 B2
APPLICATION NO. : 13/391674
DATED : July 8, 2014
INVENTOR(S) : Wood It is certified that error appears in the above-identified patent and that said Letters Patent is hereby corrected as shown below:

In the Claims

| | |
|---|---|
| Col. 8, Claim 1, Lines 46-47 | Replace "support and orientate the upper seal and the lower sealing element" with -- support and orientate the upper seal and a lower sealing element -- |
| Col. 8, Claim 1, Lines 52-53 | Replace "device around the elongate member," with -- device around the elongate member; -- |
| Col. 10, Claim 26, Line 27 | Replace "a second ram assembly on a" with -- a second ram assembly in a -- |
| Col. 12, Claim 36, Lines 21-24 | Replace "wherein at least one of the sealed bodies in each ram bore is moveable relative to the common actuator; wherein a radially outermost end of at least one of the sealing elements in each ram bore has an axial channel." with -- wherein at least one of the seal bodies in each ram bore is moveable relative to the common actuator; wherein a radially outermost end of at least one of the sealing elements in each ram bore has an axial channel in which a portion of the actuator is captive; and wherein the portion of the actuator that is captive within the channel is adapted to move along the length of the channel. -- |

Signed and Sealed this
Sixth Day of January, 2015

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,770,541 B2
APPLICATION NO. : 13/391674
DATED : July 8, 2014
INVENTOR(S) : Wood It is certified that error appears in the above-identified patent and that said Letters Patent is hereby corrected as shown below:

On the title page item [73], replace National Oilwell Varco UK, Limited with
--National Oilwell Varco UK Limited--

Signed and Sealed this
Seventeenth Day of February, 2015

Michelle K. Lee

Michelle K. Lee
*Deputy Director of the United States Patent and Trademark Office*